US009456946B2

(12) United States Patent
Hergenroeder

(10) Patent No.: US 9,456,946 B2
(45) Date of Patent: Oct. 4, 2016

(54) FLUID RECEIVING SUCTION MAT

(71) Applicant: Patrick T. Hergenroeder, Richfield, OH (US)

(72) Inventor: Patrick T. Hergenroeder, Richfield, OH (US)

( * ) Notice: Subject to any disclaimer, the term of this patent is extended or adjusted under 35 U.S.C. 154(b) by 0 days.

(21) Appl. No.: 14/689,738

(22) Filed: Apr. 17, 2015

(65) Prior Publication Data

US 2015/0297434 A1 Oct. 22, 2015

Related U.S. Application Data

(60) Provisional application No. 61/980,893, filed on Apr. 17, 2014.

(51) Int. Cl.

| | |
|---|---|
| ***B65D 1/34*** | (2006.01) |
| ***A61G 13/10*** | (2006.01) |
| ***A61G 10/00*** | (2006.01) |

(52) U.S. Cl.

CPC ..... *A61G 13/102* (2013.01); *A61G 10/00* (2013.01)

(58) Field of Classification Search

CPC ..... A61G 13/102; Y10T 137/5762; Y10T 137/6988; A61M 1/0023

USPC ..... 137/312, 362; 604/317, 322, 356; 4/640; 222/108; 220/571

See application file for complete search history.

(56) References Cited

U.S. PATENT DOCUMENTS

| | | | | |
|---|---|---|---|---|
| 1,948,327 A * | 2/1934 | Berwick | B60N 3/044 | 428/138 |
| 2,546,394 A * | 3/1951 | Harmon | A47G 27/0231 | 248/633 |
| 4,679,590 A * | 7/1987 | Hergenroeder | A61G 10/00 | 137/312 |
| 4,729,404 A * | 3/1988 | Hergenroeder | A61G 10/00 | 137/312 |
| 5,034,006 A * | 7/1991 | Hosoda | A61M 1/0084 | 604/268 |
| 6,938,639 B1 * | 9/2005 | Robinson | A61G 13/102 | 128/849 |

* cited by examiner

*Primary Examiner* — John K Fristoe, Jr.
*Assistant Examiner* — Reinaldo Sanchez-Medina
(74) *Attorney, Agent, or Firm* — Tarolli, Sundheim, Covell & Tummino LLP

(57) ABSTRACT

A mat for collecting fluid spilled onto a floor that includes a body of small thickness relative to its length and width and having an upper surface defining a plurality of receptacles and a lower surface defining a plurality of diagonally oriented channels or passages that communicate with each other and with the drains. The diagonal channels have distal ends that terminate in an end wall and inner ends that communicate directly or indirectly with a collection channel, the collection channel having a discharge port that is connectable to a suction source. The diagonal channels are formed in two groups that are disposed symmetrically about the collection channel. The mat is especially suitable for use on the floor of an operating room, as well as the floor of a food processing or manufacturing facility where fluids are spilled. The mat may include a anti-microbial, anti-bacterial and/or disinfectant treatment which may be effected by treating the mat after it is molded or adding the treatment compounds to the material from which the mat is molded.

13 Claims, 5 Drawing Sheets

FLUID RECEIVING SUCTION MAT

RELATED APPLICATIONS

This application claims priority from U.S. Provisional Application Ser. No. 61/980,893, filed Apr. 17, 2014, the subject matter of which is incorporated herein in its entirety.

TECHNICAL FIELD

This invention relates to a receptacle for collecting fluid and more particularly to a receptacle in the nature of a mat for use on the floor of an operating room.

BACKGROUND ART

In arthroscopic surgical procedures saline solution is introduced about the area being operated on and circulation of such fluid is continued during the procedure. For example, in performing arthroscopic surgery on a knee joint, saline solution is forced under pressure into the knee joint through a tube inserted through a small incision in the overlying skin and synovial membrane and is removed through a second incision. Solution tends to escape during this process and typically runs onto the operating room floor. Several gallons of fluid may be lost during surgical procedures. In many instances use of the operating room is delayed between patients while solution that has accumulated on the operating room floor is removed.

DISCLOSURE OF THE INVENTION

The present invention provides a fluid receiving and capturing device in the general form, i.e., size and shape, of a mat for support on a floor, constructed to effectively collect fluid that would otherwise fall onto the floor and to facilitate continual removal of the collected fluid. As an example, the mat is large enough to directly receive and collect fluid beneath a substantial area, such as the entire area where a solution may be escaping in a surgical procedure. The mat isolates collected fluid beneath an upper surface to avoid spillage or immersion of objects in the collected fluid, provides channels between the mat and the supporting floor for carrying away collected fluid, and facilitates movement of equipment across the mat when necessary.

The mat is molded of natural or synthetic rubber or suitable plastic, and is flexible enough to conform to the general contour of the supporting surface, which is typically flat but may not be perfectly planar, has a tendency to cling to the supporting surface, and is relatively thin compared to its length and width. A lower surface forms seals with the support surface about the periphery of the mat and also along collecting channels in the lower surface.

According to one preferred embodiment, a plurality of shallow receptacles is formed by the upper surface, each with a substantially central recess and a drain that communicates to the lower surface. A plurality of diagonally oriented channels or passages formed by the lower surface communicate with each other and with at least some of the drains. The channels are isolated from communicating directly with an edge of the mat to constrain fluid to an area beneath the receptacles. The mat also includes a discharge port communicating with the channels, the discharge port being constructed and arranged to connect with a suction source.

According to this one embodiment, the diagonally oriented channels or passages are formed into two groups, each of the channels of a given group being in a parallel relationship and each channel having a distal end terminating in an end wall and each channel having an inner end that communicates directly or indirectly with a collection channel. In the illustrated embodiment, the diagonal channels form an oblique angle with respect to the collection channel. In a more preferred embodiment, one group of diagonal channels join the collection channel at a first oblique angle and the diagonal channels of the other group join the collection channel at another oblique angle. In the illustrated embodiment, each of these oblique angles may be substantially 45° with respect to the collection channel.

In the illustrated construction, an upper surface forms a gridwork of shallow fluid-collecting receptacles, each with a drain that communicates to the lower surface and the fluid receiving drain and collecting channels. In the preferred and illustrated embodiment, the mat comprises a plurality of receptacles, each defined by a funnel or inverted pyramid-shaped section. The funnel section is comprised of four triangular-shaped segments having inner ends that merge with a circular recess or depression. A drain port is preferably formed generally centrally in the recess portion and communicates with drain channels formed on the underside of the mat. The channels communicate with a centrally positioned collection channel or manifold and a discharge port through which collected fluid is evacuated. This construction is economical to manufacture, effectively collects and contains fluid to permit its continual and convenient removal, is especially adapted for use directly on the floor of an operating room without obstructing passage of people or equipment. The mat connects to standard operating room suction equipment.

According to a feature of the invention, the mat of the present invention may be treated with an anti-microbial, anti-bacterial and/or disinfectant material/compound. The present invention contemplates applying these materials externally to the mat or, alternately, adding these compound/compositions directly to the material from which the mat is molded.

The mat of the present invention has many uses. As indicated above, it can be used in a surgical environment to capture fluids spilled onto the floor during a surgical procedure. The invention also contemplates the use of these mats in other environments where fluids are spilled, such as food processing, as well as manufacturing facilities where fluids are spilled onto the factory floor.

From the foregoing it can be appreciated that, in its broad form, the receptacle of the present invention is comprised of a thin body having a plurality of shallow basins in an upper surface and channels in a lower surface communicating with the basins, and a discharge port communicating with the channels. Those and other more specific features of the invention will become better understood from the detailed description that follows.

BEST MODE FOR CARRYING OUT THE INVENTION

Figure 1A:
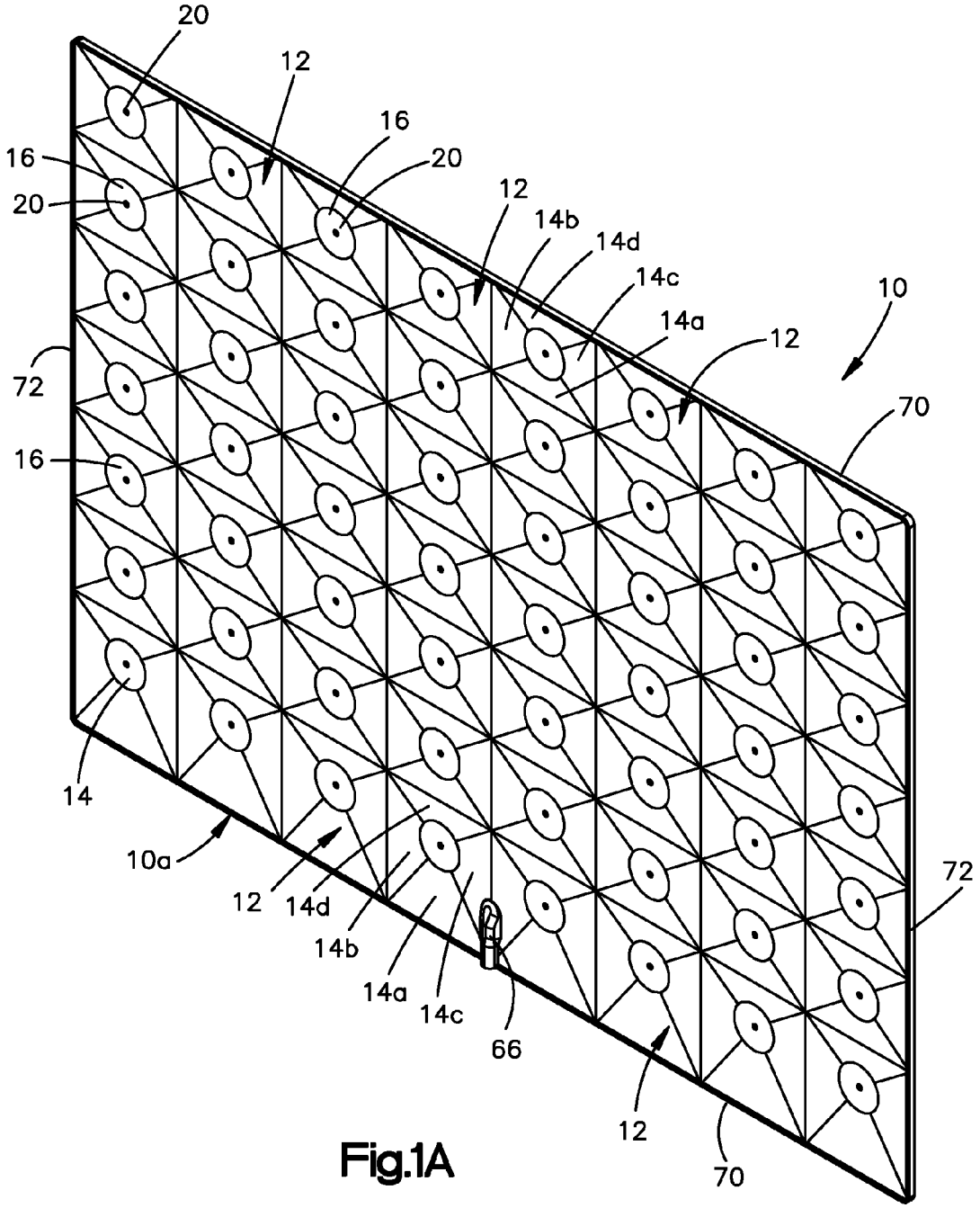
FIG. 1A is a perspective view showing a top surface of a mat embodying the present invention.
Figure 1C:
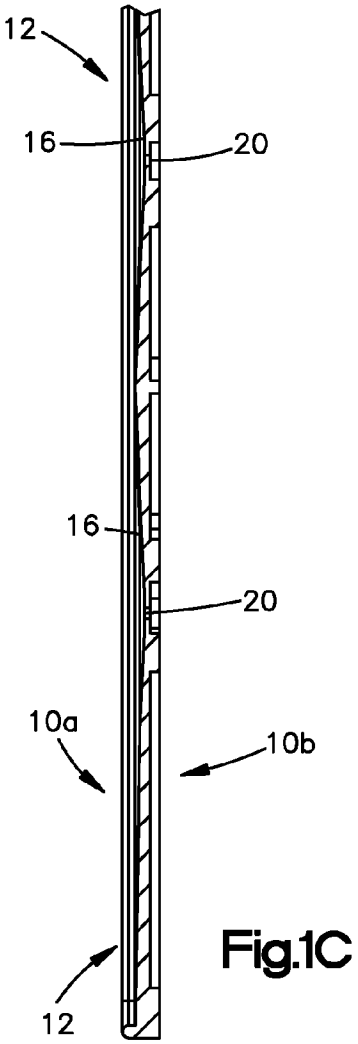
FIG. 1C is a cross-sectional view of the mat shown in FIG. 1A as seen from the plane indicated by the line 1C-1C in FIG. 1B.

FIG. 1A illustrates the overall construction of a mat 10 constructed in accordance with one preferred embodiment of the invention. The illustrated mat 10 is rectangular in shape and is preferably molded from a rubber material such as natural or synthetic rubber or plastic so that it is flexible. The illustrated mat may be used in a surgical environment. In FIG. 1A, an upper or top surface 10*a* of the mat 10 is illustrated, i.e., the surface which is exposed when the mat is positioned on the floor of an operating room. When used in an operating room environment, the mat 10 is operative to collect fluids generated and discharged during a surgical procedure. These fluids may include, but are not limited to, saline solutions and body fluids.

Figure 1B:
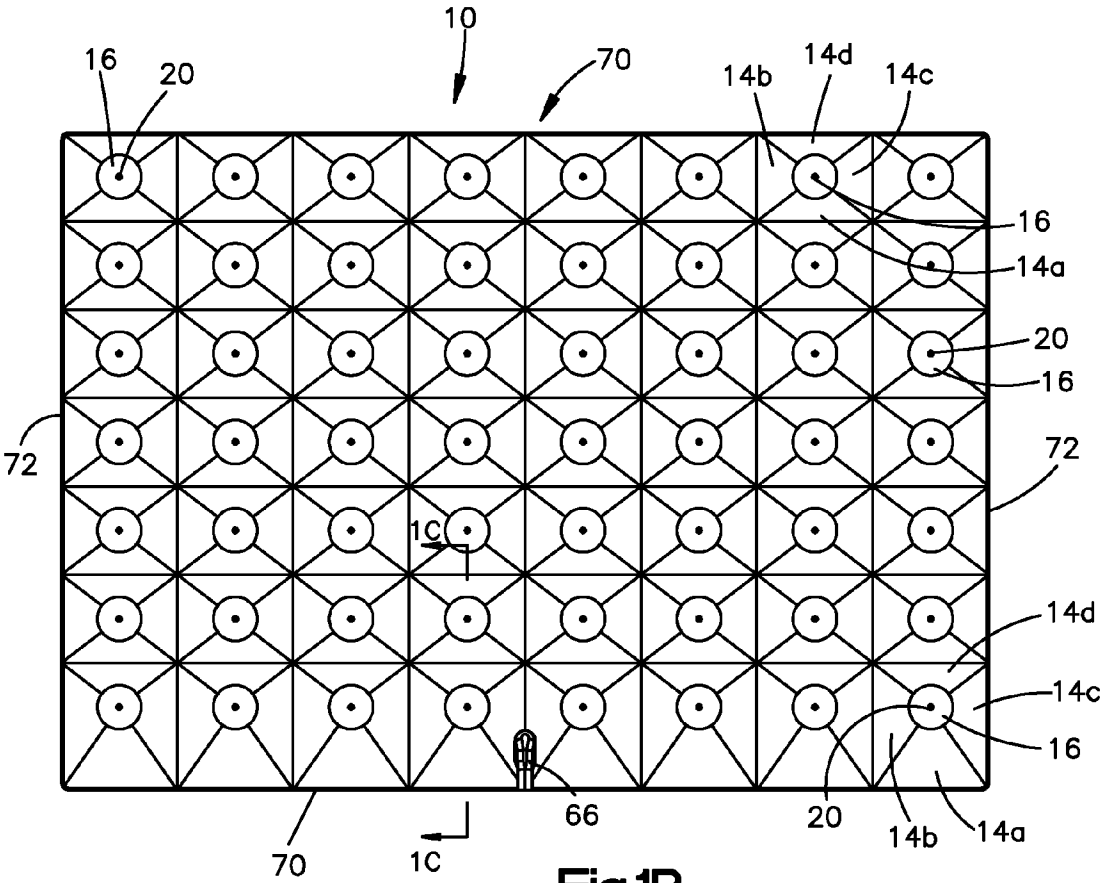
FIG. 1B is a plan view of the mat shown in FIG. 1A.
Figure 1D:
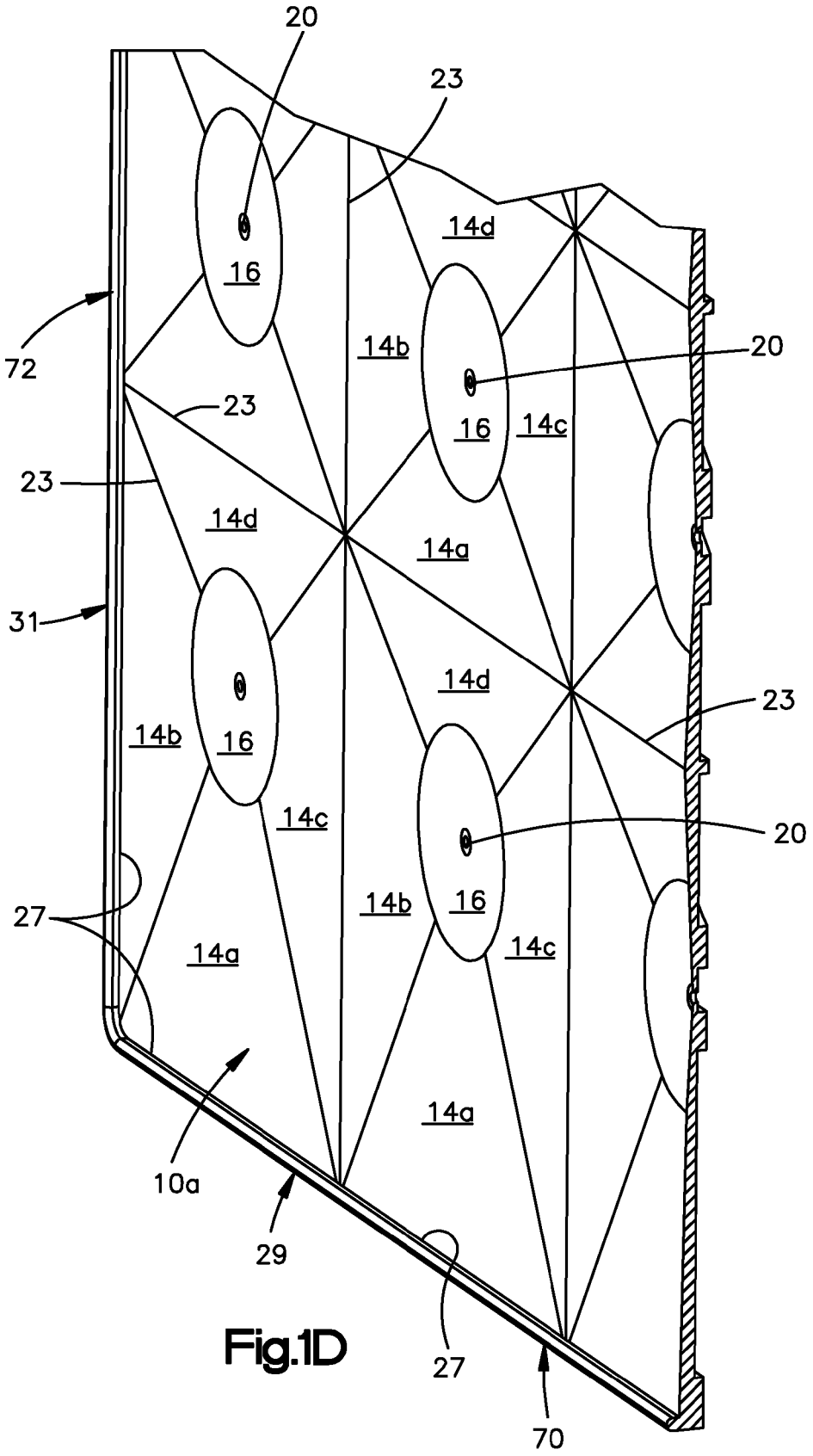
FIG. 1D is a fragmentary, perspective view of the mat shown in FIG. 1A.

The illustrated mat is an enhancement or improvement in the mat disclosed in U.S. Pat. No. 4,679,590 which is hereby incorporated by reference. The mat 10 is adapted to rest on the surgical floor and when a vacuum is applied, a suction is created under the mat, as will be explained, causes the mat to sealingly engage the floor surface. Referring also to FIG. 1D, the mat 10 comprises a plurality of integrally formed fluid receiving receptacles or basins 12 that are formed in the top surface 10*a*. As seen best in FIG. 1D, each fluid collecting receptacle 12 comprises an four-sided inverted pyramid-like or funnel shaped structure defined by four (4) triangular sides, the inner ends of which merger into and/or join a circular depression 16. Each funnel-shaped structure comprises four triangular shaped segments 14*a*, 14*b*, 14*c*, and 14*d*. A drain port 20 is positioned generally in the center of each circular recess and preferably is located in the lowest region of each recess so that fluids received in receptacle generally flow to the drain port 20.

Figure 2A:
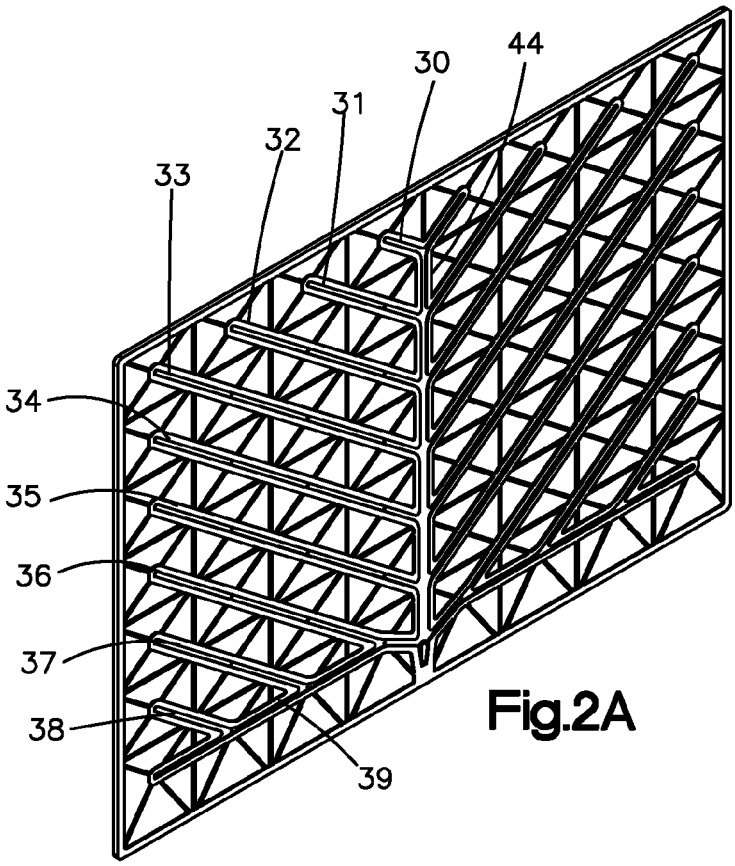
FIG. 2A is a perspective view showing the underside of the mat constructed in accordance with a preferred embodiment of the invention.
Figure 2B:
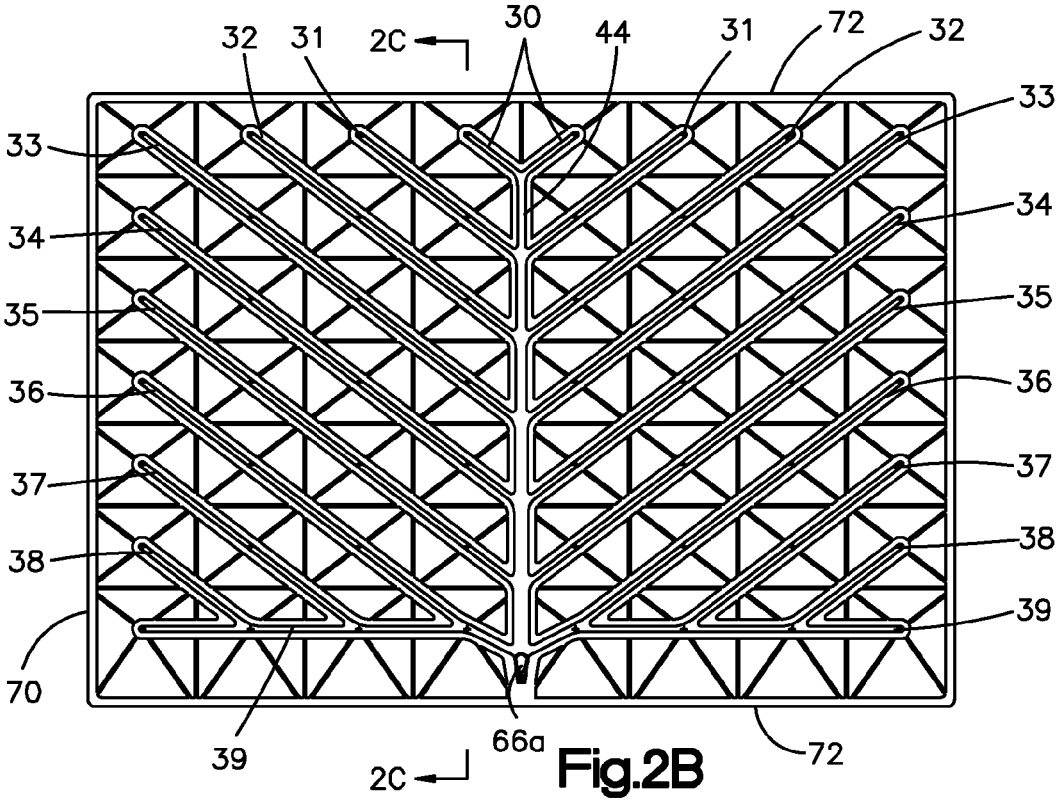
FIG. 2B is a plan view of the underside of the mat shown in FIG. 2A.

FIGS. 2A and 2B illustrate an underside of the mat 10*b*, i.e., the side of the mat which abuts the floor. As seen best in FIG. 2B, an array of drain or fluid receiving diagonal channels or passages 30-38 and a transverse channel or passage 39 is formed in the undersurface of the mat. The drain channels are preferably integrally molded in the mat 10. In the preferred embodiment, a centrally positioned collection channel 44 is formed in the mat. The generally diagonally oriented receiving channels 30-36 have inner ends that communicate with the main collection channel 44. The diagonal channels 37, 38 have inner ends that fluidly communicate with the transverse channel 39 and in turn, an inner end if the transverse channel 39 communicates with the collection channel 44. The diagonally oriented and transverse channels 30-39 communicate with and receive fluid from the individual drain ports 20 (shown best in FIG. 1D) that are generally centrally positioned within each receptacle 12.

Figure 2C:
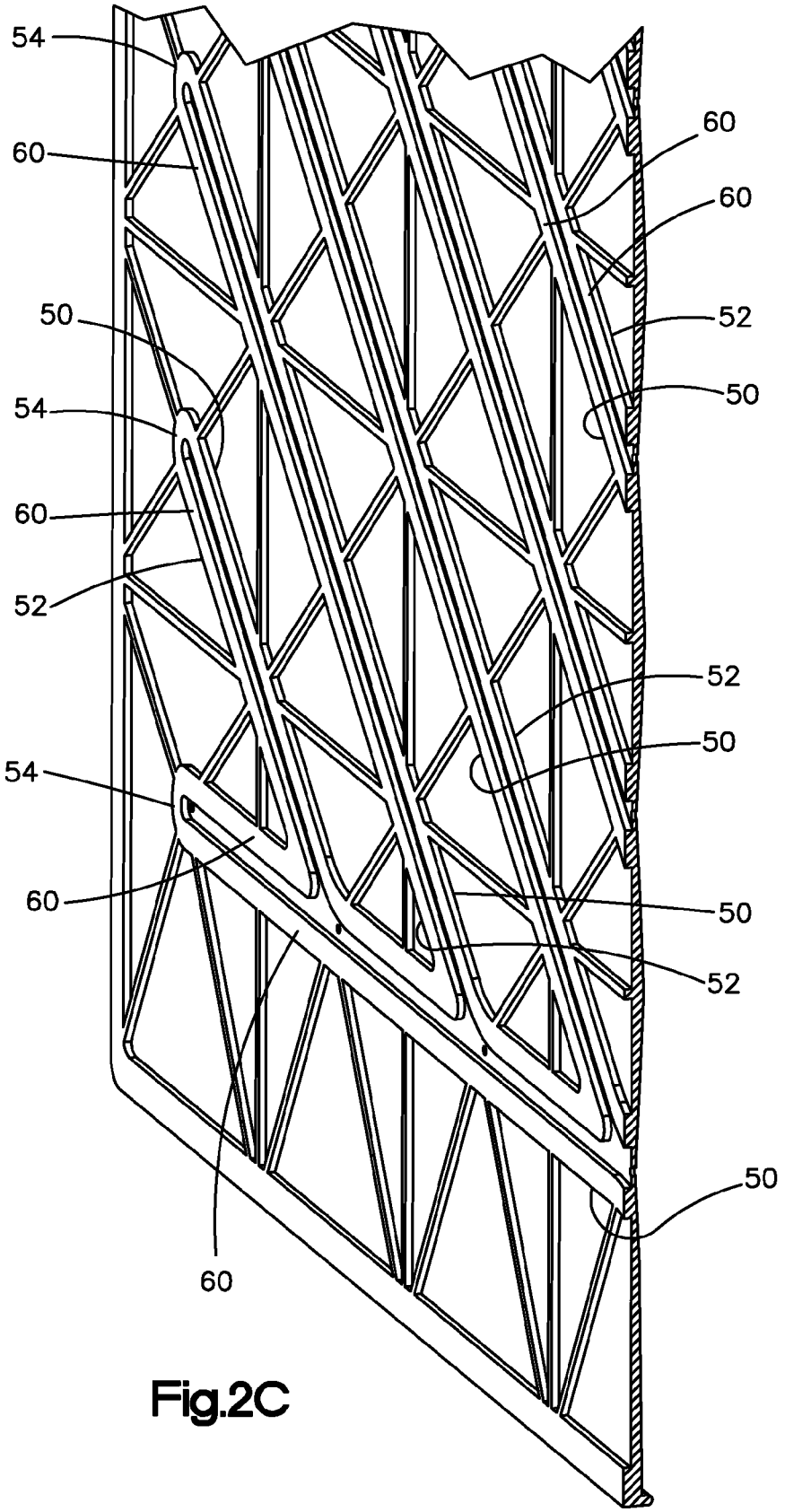
FIG. 2C is a fragmentary, perspective view of the underside of the mat.

Preferably the receiving channels 30-39 are linear and each comprise a pair of parallel integrally formed depending walls 50, 52 (see FIG. 2C). The walls are spaced apart and define a fluid channel therebetween. An arcuate wall segment or end wall 54 joins outer ends of each wall segment thereby terminating and enclosing the fluid channel at its distal end. Wall end surfaces 60 of the depending walls 50, 52 are substantially flat and level and preferably rest uniformly on the floor when the mat is in its operative position. The flat surfaces 60 of each channel form a sealing surface which provide a sealing engagement with the floor when a vacuum is applied to the channels. A suitable vacuum connection 66 is provided and an opening port 66*a* communicates vacuum to the channels 30-39, 44. As seen best in FIG. 1, the connection or nipple 66 communicates with the central collection channel 44 and is suitably connected to a source of vacuum. When a vacuum is applied, a sub-atmospheric pressure is applied to all of the fluid receiving channels 30-39 by virtue of the communication between the individual channels and the centrally positioned collection channel 44. This causes the flat surfaces 60 of the channel walls to sealingly engage the floor on which the mat is placed.

As seen best in FIG. 2B, the fluid receiving channels 30-39 are linear and form a straight path to the main receiving or collection channel 44. As a result, the collection of fluids via the drain ports 20 are highly efficient and it has been found that this arrangement results in a mat that has a larger fluid capacity for fluid removal, as compared to the prior art. As seen best in FIG. 2B, in order to affect this efficiency, the transversely extending fluid receiving channel 39 is formed which communicates with the main channel, but also communicate with inner ends of the diagonally oriented fluid receiving channels 36-38. In the illustrated embodiment, the transverse channel 29 communicates with the three diagonally oriented fluid receiving channels. Depending on the shape and size of the mat, the number of the diagonally oriented fluid receiving channels communicating with the transverse channel 39 may vary.

Referring to FIG. 2B, in the preferred and illustrated embodiment, the fluid receiving channels 30-36 join the main collection channel 44 at an oblique angle. In the preferred embodiment, and as seen best in FIG. 2B, the diagonal channels are arranged in two groups, with one group of diagonal channels 30-36 extending to the left of the collection channel 44 (as viewed in FIG. 2B) and the second group of diagonal channels 30-31 extending to the right of the collection channel 44 (as viewed in FIG. 2B). In the illustrated embodiment, the oblique angle formed between a diagonal channel and the collection channel 44 is about 45°. It should be understood, however, that the oblique angle can be smaller or substantially larger, depending on the transverse dimension of the mat, as viewed in FIG. 2B. As an example, if the mat shown in FIG. 2B is made substantially wider, the oblique angle between the diagonal passages 30-31 and the collection channel 44 will be substantially larger than the angle shown in FIG. 2B.

In the preferred and illustrated embodiment, the diagonal passages 30-36 of one group are the mirror image of the diagonal passages 30-36 of the other group. In other words, the diagonal passages of the groups are arranged in a symmetrical relationship about the collection channel 44. As seen in FIG. 2B, when viewed in plan, the diagonal passages and collection channel 44 have the appearance of a tree, with the trunk being formed by the collection channel 44 and the branches formed by the diagonal channel/passages 30-39.

It should be noted here that the present invention also contemplates the construction where multiple collection channels 44 are formed on the underside of the mat, each collection channel so formed would include symmetrically disposed diagonal channels that extend to either side of the collection channel. This arrangement would be used for mats having transverse dimensions (as viewed in FIG. 2B) that are substantially larger than the longitudinal dimension of the collection channel 44.

Unlike the prior art, the flow path for fluid received from the drain ports 20 is generally linear with a minimum number of direction changes. This results in a highly efficient system for removing the fluids received by the top surface 10*a* of the mat 10 during a surgical procedure.

In the preferred construction shown, the basins 12 are peripherally square and directly abut one another to form an array of adjacent basins. Each basin slopes from the four sides 14*a*-14*d* that form the perimeter and join the central depression 16. A drain 20 in the form of a circular opening is located in the center of each basin. The sloping basin surface is comprised of four flat triangular-shaped segments 14*a-d*, the base of each triangular-shaped segment lying along an upper side and the inverted apex located at the central depression 16. The circular opening forming the drain 20 extends through the receptacle 12, communicating from the top surface 10*a* to the bottom surface 10*b*.

Referring to FIG. 1D, sides 23 of the receptacles 12 form a gridwork of ridges 27 that run both parallel and perpendicular to side edges of the mat. The ridges formed by the junctures of the adjacent receptacles 12 are essentially lines without flat surface areas between basins. As a result, there is no portion of the top surface 10*a* of the receptacle where standing fluid can accumulate; rather, all areas within the side edges 23-27 direct any fluid received toward the drains 20. Also, by virtue of the many receptacles 12, which are small relative to the overall mat size, the slope of the segments 14*a-d* is sufficiently steep, notwithstanding the small height of the receptacle, to promote rapid flow of fluid along the segment surfaces to the drains. To further confine and reduce chances of fluid flowing from the mat and onto the surrounding floor, a raised peripheral lip 73 is formed on the upper surface 10*a* of the mat.

The walls 50, 52 forming the fluid receiving and collecting, channels 30-39, 44 provide suitable depth to the channels sufficient to allow receipt of fluid through the drains 20 and sufficient to accommodate flow of fluid beneath the recessed bottom surface portions that form the tops of the various channels, between the channel-forming walls 50, 52. The wall bottoms 60 form seals with the supporting floor (not shown) to effectively confine the collected fluid to the fluid receiving and collecting, channels 30-39, 44. However, in the event any leakage from the channels should occur, the leakage will be received in the areas or zones between the walls 50, 52 underlying the receptacles 12, and ultimately will be confined by the peripheral edges or lips 20, 22 of the bottom surface 10*b* of the mat 10.

It will be understood that the entire bottom surface 18 could be flat, with only the various channels formed therein as grooves, but without the savings in weight and material gained with the preferred embodiment.

In use, the mat 10 is placed on a floor, where falling fluid is to be collected. Fluid dropping onto the top surface 10*a* of the mat will be caught in one or more of the receptacles or basins 12, flow down the triangular shaped surfaces to the circular recesses or depressions 16 and through the central drains 20. The appropriate underlying drain channels 30-39 will conduct the fluid received from the drains 20 to the collection channel 44 and thence to the suction port 66. Thus, fluid collected is immediately removed from the top surface 10*a* to a location beneath the receptacles, between the mat and floor, where it is isolated against spilling and whereby splashing is minimized as additional fluid is collected. The arrangement facilitates the continual removal of collected fluid so that large quantities of fluid can be collected, notwithstanding the relatively small height and volume of the receptacles.

The seal formed between the bottom surface 10*b* of the mat 10 and the floor prevents leakage, and in addition, use of the floor to, in part, form the collection and discharge conduits keeps the height of the receptacle to a minimum. The material of which the receptacle is formed is flexible and sufficiently soft to achieve a good seal with a smooth floor typical of surgical operating rooms. Where the area for fluid collection is large, several mats can be arranged next to one another to form a solid area of receptacles for collecting fluid over the larger area.

By way of example only and not by way of limitation, a preferred embodiment of the invention, found especially suitable for use in surgical operating rooms for arthroscopy, particularly arthroscopy of the knee joint, utilizes a mat as shown in the drawings, having dimensions of about 34 inches by 47 inches, and generally ¼ inch in height. The receptacles 12, as seen best in FIG. 1B are generally 6 inches by 4½ inches. However, in the illustrated mat, the lowest row 77 of receptacles 12 (as seen in FIG. 1B) are 6 inches by 4½ inches. The central basin 16 of each receptacle is approximately 0.235 inches in diameter. The peripheral lip 73 is approximately 0.100 inches above the general height of the mat 10. The height of the walls 50, 52 that form the collecting and drain channels 30-39, 44 are 0.095 inches in height. The discharge port 66*a* is 0.312 inch in diameter. The preferred embodiment is molded of a blend of vulcanized natural and/or synthetic elastomers.

The present invention also contemplates the use of antimicrobial, anti-bacterial and/or disinfectant compounds/compositions as part of the mat The mat may be treated with one or more of these materials after the molding process or, alternately, these compounds/compositions may be added directly to the molding material prior to the molding process. After the molding process, the mat may be treated with one or more of these compounds, either by dipping the mat into a bath containing these compositions, or spraying one or more of these compositions onto the mat. The mat may also be subjected to an additional process step to embed or otherwise secure these materials to the surface of the mat.

The present invention has been described in connection with a mat that would be used in a surgical environment. The present invention, however, also contemplates use in other applications where fluids are spilled onto the floor, For example, the disclosed mat has uses in the food preparation industry, as well manufacturing processes where fluids/solutions are spilled onto a factory floor. The present invention should not be limited to the surgical environment While a preferred embodiment of the invention has been described in detail, it will be apparent that modifications and alterations may be made therein without departing from the spirit and scope of the invention set forth in the appended claims.

What is claimed is:

1. A mat for collecting fluid comprised of a body having an upper surface and a lower surface, a plurality of shallow receptacles formed by the upper surface each with a substantially central recess and a drain that communicates to the lower surface, a plurality of diagonally oriented channels formed by the lower surface communicating with each other and with at least some of said drains and isolated from communicating directly with an edge of the mat to constrain fluid to an area beneath the receptacles, said diagonally oriented channels being formed in two groups, each of the channels of a given group being in a parallel relationship, each channel having a distal end terminating in an end wall and each channel having an inner end that communicates directly or indirectly with a collection channel and a discharge port communicating with the channels, said discharge port being constructed and arranged to connect with a suction source.

2. The mat of claim 1 wherein said diagonal channels and collection channel when viewed in plan, have the appearance of a tree having a trunk formed by the collection channel and said diagonal channels forming branches.

3. The mat of claim 1 wherein each of said diagonal channels forms at an oblique angle with respect to said collection channel.

4. The mat of claim 3 wherein said one group of diagonal channels join said collection channel at an oblique angle that is 90° offset from the angle at which the diagonal channels of said other group join said collection channel.

5. The mat of claim 1 further comprising at least one transverse channel having a distal end enclosed by an end wall and an inner end that fluidly communicates with said collection chamber, and arranged such that at least some of said diagonal channels have inner ends that fluidly communicate with said transverse channel.

6. The mat of claim 5 formed from an elastomeric, moldable material.

7. The mat of claim 6 wherein said elastomeric moldable material includes, or is treated with, an anti-microbial compound.

8. The mat of claim 6 wherein said elastomeric moldable material includes, or is treated with, an anti-bacterial compound.

9. The mat of claim 1 wherein further adapted for use on the floor of a surgery facility.

10. The mat of claim 6 wherein said elastomeric material includes, or is treated with a disinfectant.

11. A fluid receiving mat for use on the floor of an operating room to collect and facilitate removal of fluid that would otherwise flow onto the floor during a procedure, said mat comprising a flexible body of small thickness relative to its length and width and having a lower supporting surface constructed to lie and seal against and follow the contour of a floor and an upper surface having a plurality of basins having drain openings that communicate to the lower surface, a plurality of parallel diagonal passages formed in the lower surface communicating with said drains and isolated from direct communication with a body periphery so that fluid entering the passages from the drains is constrained by the lower surface to an area beneath the body, a collection channel communicating with inner ends of said diagonal passages and a discharge port communicating with the collection channel at the periphery of the body constructed and arranged to connect with a suction source and wherein said parallel diagonal passages are arranged in two groups, the diagonal passages of one group arranged at a first oblique angle with respect to said collection channel and the diagonal passages of the other group arranged at a second oblique angle with respect to said collection channel.

12. The mat of claim 11 wherein said collection channel is centrally positioned such that the diagonal passages of one group extend away from said collection channel in one direction and the diagonal passages of the other group extend from said collection channel in another opposite direction.

13. The mat of claim 12 wherein said diagonal passages are disposed in a symmetrical pattern with respect to said collection channel.

* * * * *